US006509834B1

(12) United States Patent
Lin

(10) Patent No.: US 6,509,834 B1
(45) Date of Patent: Jan. 21, 2003

(54) DEVICE HAVING VEHICLE REMOTE CONVENIENCE CONTROL AND INTERPERSONAL COMMUNICATION FUNCTION ABILITIES

(75) Inventor: Xing Ping Lin, Orchard Lake, MI (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/921,360

(22) Filed: Aug. 2, 2001

(51) Int. Cl.[7] ..... G08B 1/08
(52) U.S. Cl. ..... 340/539; 340/3.7; 340/3.71
(58) Field of Search ..... 340/539, 3.7, 3.71, 340/5.1, 7.21, 815.53, 573.1

(56) References Cited

U.S. PATENT DOCUMENTS 4,406,998 A * 9/1983 Willough ..... 340/815.4
5,544,305 A * 8/1996 Ohmaye et al. ..... 345/776
5,808,663 A * 9/1998 Okaya ..... 348/14.1
5,815,147 A * 9/1998 Bogen et al. ..... 345/835

* cited by examiner

*Primary Examiner*—Daryl Pope
(74) *Attorney, Agent, or Firm*—Tarolli, Sundheim, Covell, Tummino & Szabo L.L.P.

(57) ABSTRACT

A device (10) is presented for controlling remote convenience function at a vehicle (32) and for interpersonal communication between two operators. The device (10) has components located in a common housing (24). The components include structure (e.g., 14–22) for communicating input from an operator of the device, structure for generating radio frequency signals responsive to the input from the operator of the device, structure for receiving other radio frequency signals from another device responsive to communication input from a operator of another device, and structure for converting the other signals from the operator of the other device into output perceptible by the operator of the device. The output corresponds to the input communicated from the operator of the other device.

20 Claims, 5 Drawing Sheets

DEVICE HAVING VEHICLE REMOTE CONVENIENCE CONTROL AND INTERPERSONAL COMMUNICATION FUNCTION ABILITIES

TECHNICAL FIELD

The present invention relates to a device having multi-function capabilities including a function for remotely controlling a convenience function at a vehicle and a function for enabling interpersonal communication.

BACKGROUND OF THE INVENTION

Digital interpersonal communications devices include cellular telephone technology. Some digital cellular telephones are capable of transmitting and receiving verbal as well as textual messages. Digital cellular telephones include a receiver and a transmitter for transmitting and receiving radio frequency signals to and from other cellular telephones

TECHNICAL FIELD

The present invention relates to a device having multi-function capabilities including a function for remotely controlling a convenience function at a vehicle and a function for enabling interpersonal communication.

BACKGROUND OF THE INVENTION

Digital interpersonal communications devices include cellular telephone technology. Some digital cellular telephones are capable of transmitting and receiving verbal as well as textual messages. Digital cellular telephones include a receiver and a transmitter for transmitting and receiving radio frequency signals to and from other cellular telephones to enable communication between two cellular telephone users.

Remote convenience vehicle function control (e.g., a remote keyless entry or RKE) systems are known in the art and include a receiver mounted in a motor vehicle and at least one portable hand held transmitter located remote from the receiver. Each transmitter is provided with a plurality of manually actuatable switches, each representative of a vehicle control function to be performed, such as unlocking the vehicle door. The transmitter responds to the actuation of one of the switches to transmit a digital signal having a security code which uniquely distinguishes the transmitter from a plurality of similar transmitters and a function code representative of the control function to be performed. When the receiver receives such a digital signal, it compares the received security code with a stored security code. If a match takes place, the receiver responds to the function code by causing performance of the control function requested, as by unlocking a vehicle door.

SUMMARY OF THE INVENTION

In accordance with one aspect, the present invention provides a system for controlling a remote convenience function at a vehicle and for interpersonal communication. The system includes a device that has components located in a common housing. The components include means for communicating inputs from an operator of the device. The inputs include a request to remotely control performance of a convenience function at the vehicle and an interpersonal communication. The components include means for converting the inputs from the operator of the device into radio frequency signals, and means for transmitting the signals for receipt at the vehicle and at a component. The system includes first means, at the vehicle, for receiving one of the transmitted signals to cause performance of the remotely requested vehicle function at the vehicle. The system includes second means, at the component, for receiving another of the transmitted signals to convey the interpersonal communication, and means, associated with the component, for converting the other signal into output perceptible by a person as the communication.

In accordance with another aspect, the present invention provides a device for controlling a remote convenience function at a vehicle and for interpersonal communication. The device has components located in a common housing. The components include means for communicating input from an operator of the device. Means converts the input from the operator of the device into radio frequency signals. Means transmits the signals for receipt by one of the vehicle and another device. Means receives another radio frequency signal transmitted from the other device. The other signal is generated from communication input from an operator of the other device. Means converts the other signal into output perceptible by the operator of the device. The output corresponds to the input communication from the operator of the other device.

In accordance with another aspect, the present invention provides a system that has first and second devices. Each of the first and second devices performs the combination of a vehicle remote access function and an interpersonal communication function. A first operator operates the first device. A second operator operates the second device. Each of the first and second devices has components located in a common housing. The first device includes means for receiving a communication signal from the second device, and means for processing the communication signal received from the second device to provide communication to the first operator. Means processes input from the first operator indicating which of the functions to perform. Means generates a communication signal and a vehicle remote convenience function signal from the first operator input. Means transmits the communication signal from the first device for receipt by the second device, and for transmitting the vehicle remote convenience function signal from the first device for receipt by a vehicle.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
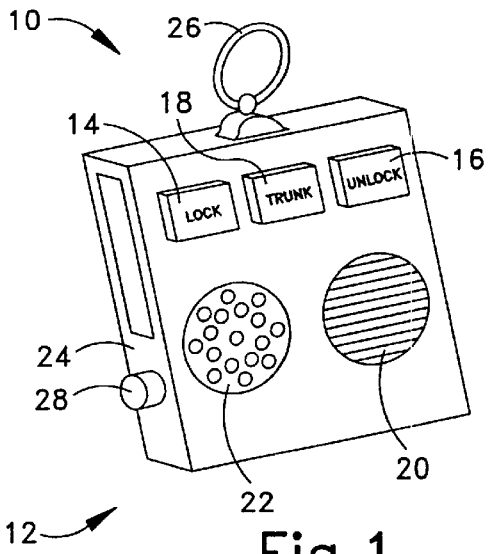
FIG. 1 is a pictorial view of a device in accordance with the invention in the form of a key holder.

The present invention relates to a device having multi-function capabilities including a function for controlling remote access to a vehicle and a function for enabling interpersonal communication. As representative of the present invention, FIG. 1 illustrates a portable device 10 that is constructed in accordance with the present invention.

The device 10 is a singular unit having components located in a common housing 24. The components of the device 10 include a transceiver unit TA 12 which is a hand-held key ring having an appropriate array of finger tip switches 14, 16, 18, 21 a speaker 20, and microphone 22, in the case or housing 24 which can include a key ring 26 on a swivel connection. The microphone 22 as well as switches 14, 16, 18, 28 are means for communicating input from an operator of the device 10. The switches 14, 16, 18 each correspond to a different vehicle control function described below. The switch 28 corresponds to a communication function also described below.

The hand-held case 24 can be retained by the operator so that as the operator approaches the vehicle 32, signal S1 can be transmitted to a vehicle receiver unit R by merely depressing one of the finger operated switches 14, 16, 18. Alternatively, the hand-held case 24 can be retained by the operator so that as the operator approaches another operator having a another transceiver unit TB 30, signal S2 can be transmitted to the transceiver unit TB 30 by depressing the switch 21. The range of both of the signals transmitted is within 50–100 feet.

Transceiver unit TB 30 is similar to transceiver unit TA 12 except that transceiver unit TB has a unique security code different than transceiver unit TA. The security code is unique to every transceiver and is used for identification purposes. The security code permits communication of signals only between the desired transceivers and the desired receiver in the vehicle to prevent unauthorized access to the vehicle and/or the transceivers.

The manner in which a security code to identify a particular device used in the present invention is similar to the manner in which a security code is used to identify a particular RKE and is known in the art. That is, each digital signal generated by the device 10 has a portion including a unique security code and a function code. Each digital signal, when received by the vehicle 32 or another transceiver, is first compared to a stored security code. No further action is taken if an identification match is not made. If a match is made, the transceiver or receiver responds to the function code and a control function in performed, such as unlocking a vehicle door or communicating a message.

The vehicle 32 includes a controller and a receiver R having receive circuitry for receiving and for processing the signal with stored vehicle subroutines which include the vehicle control functions, described hereafter.

Another component of the device 10 is transceive circuitry located in the transceiver units TA 12 and TB 30. If the operator wishes to carry out one of the vehicle control functions, the operator simply depresses one of the switches 14, 16, 18 to generate a radio frequency signal S1 corresponding to the switch depressed which is received by he vehicle receiver R mounted on the vehicle 32.

Figure 4:
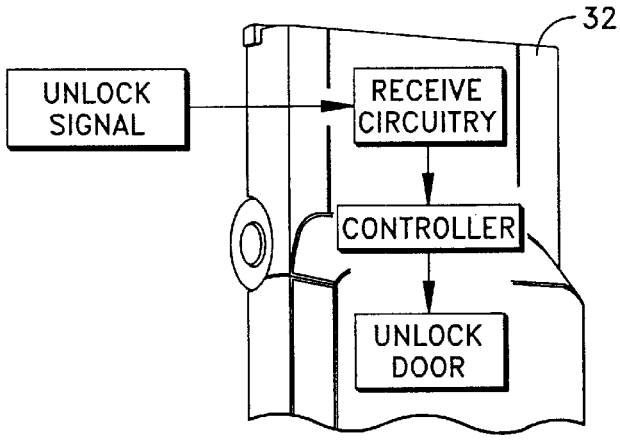
FIG. 4 is a schematic view of the operation of the device of the invention.

Referring now to FIG. 4, if the operator depresses switch 16, a signal S1 is generated and is transmitted for receipt by the vehicle receiver R indicating that the vehicle doors should be unlocked. The vehicle receiver includes receive circuitry which processes the signal. The vehicle controller executes the control function by unlocking the doors of the vehicle.

If the operator depresses switch 14, a signal S1 is generated and is transmitted for receipt by the vehicle receiver R indicating that the vehicle doors should be locked. The vehicle controller executes the control function by locking the vehicle doors.

If the operator depresses switch 18, a signal S1 is generated and is transmitted for receipt by the vehicle receiver R indicating that the trunk should be released. The vehicle controller executes the control function by releasing the trunk of the vehicle. In this aspect of the invention, the device 10 operates similarly to a conventional RKE.

Figure 3:
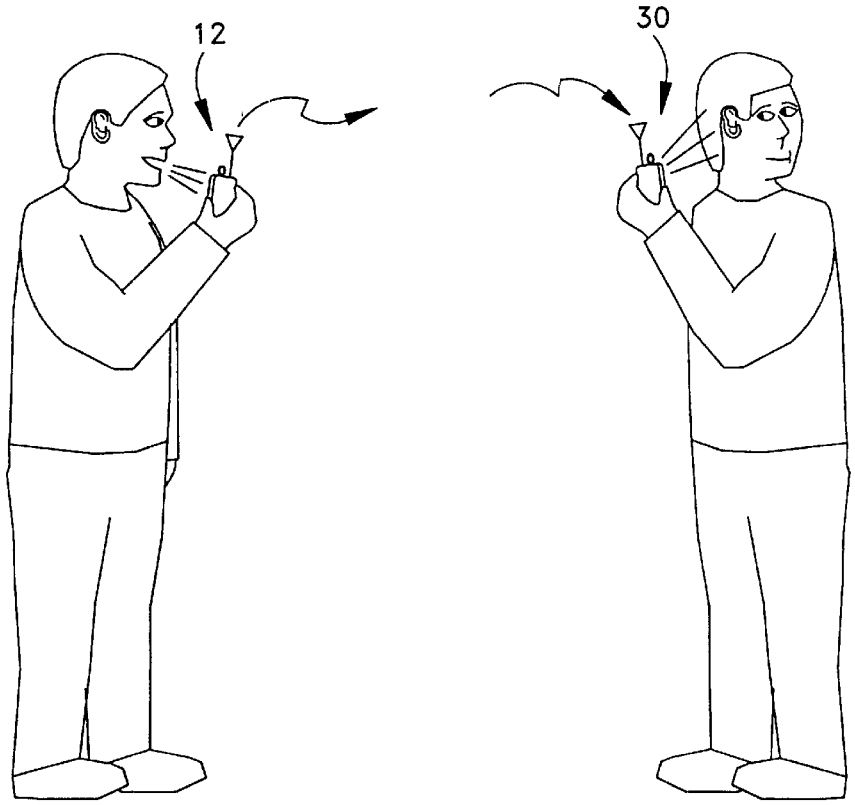
FIG. 3 is a pictorial view of the operation of two of the devices of FIG. 1.
Figure 6:
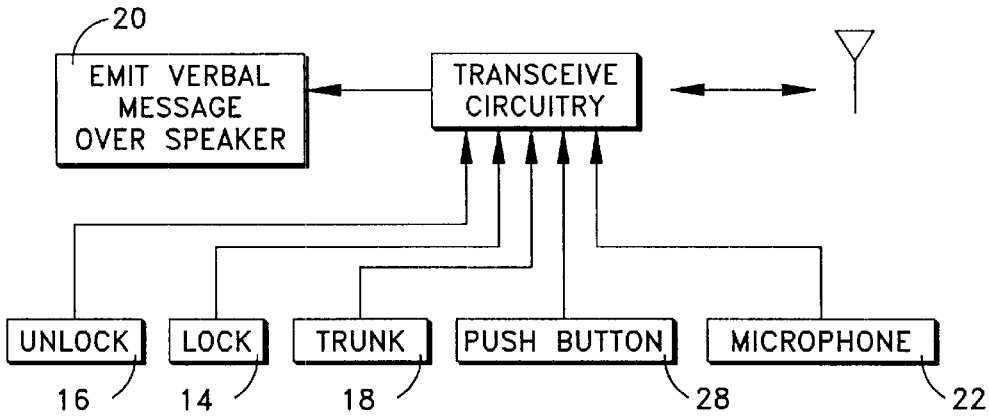
FIG. 6 is a block diagram illustrating, schematically, the device of FIG. 2.

Using the same transceiver unit TA 12 (FIG. 1), the operator can communicate a verbal message to the operator of transceiver unit TB 30 and vice versa (FIGS. 3 and 6). If the operator of transceiver unit TA 12 wishes to send a verbal message to the operator holding transceiver unit TB 30, the operator simply depresses pushbutton 28 and speaks into the microphone 22 located on the case 24. When the operator is finished speaking, the pushbutton 28 is released.

The microphone 22 is a conventional microphone, the operation of which is well known in the art. The microphone 22 converts the acoustical waves into digital signals, specifically, radio frequency signals S2 and feeds them to a broadcasting transmitter. The broadcasting transmitter is part of the transceive circuitry of the transceiver unit TA 12.

Depressing the pushbutton 28 located on one of the lateral sides of the case 24 of transceiver unit TA 12 transmits the signals S2 for receipt by transceiver unit TB 30. The transceiver unit TB 30 includes transceive circuitry for receiving and converting the signals S2 into acoustical wave output that is audible to the operator through the speaker 20. The audible output emitted through the speaker 20 is the same verbal message communicated by the operator into the microphone 22 of transceiver unit TA 12.

If the operator of transceiver unit TB 30 wishes to send a reply message to, or to initiate communication with, the operator holding transceiver TA 12, the operator of transceiver unit TB simply follows the same process as the operator of transceiver unit TA.

As mentioned above, the transceiver unit TA 12 is the same as transceiver unit TB 30 except for the unique security code. Thus, the operator of transceiver unit TB 30 simply depresses pushbutton 28 and speaks into the microphone 22 located on the case 24. When the operator is finished speaking, the pushbutton 28 is released.

The microphone 22 converts the acoustical waves into digital signals, specifically, radio frequency signals S3 and feeds them to a broadcasting transmitter. The broadcasting transmitter is part of the transceive circuitry of the transceiver unit TB.

Depressing the pushbutton 28 located on one of the lateral sides of the case of transceiver unit TB 30 transmits the signals S3 for receipt by transceiver unit TA 12. The transceiver unit TA 12 includes transceive circuitry for receiving and converting the signals S3 into acoustical wave output that is audible to the operator through the speaker 20. The output is the same verbal message communicated by the operator into the microphone 22 of transceiver unit TA 12. The operator of transceiver unit TB 30 can also send signals to the vehicle for controlling access to the vehicle.

Figure 2:
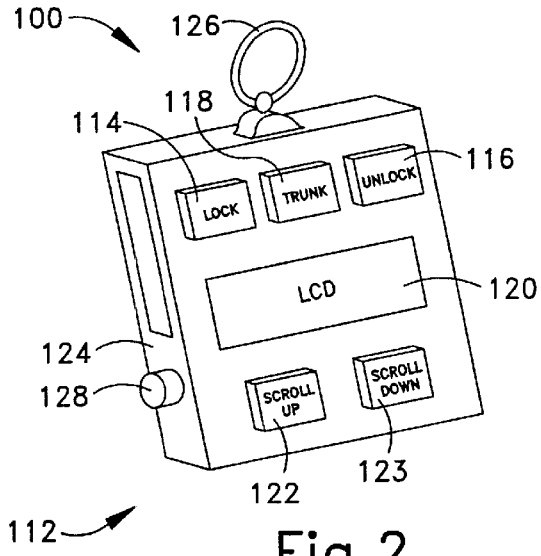
FIG. 2 is a pictorial view of a second embodiment of the device in the form of a key holder.

FIG. 2 illustrates another embodiment of a device 100 that is constructed in accordance with the present invention. The device 100 illustrated in FIG. 2 is similar in appearance to the device 10 illustrated in FIG. 1. Both the device 10 and the device 100 are for controlling remote access to a vehicle 32, however, the device 10 is for verbal communication whereas the device 100 is for textual communication.

The device 100 is a singular unit having components located in a common housing 124. The components of the device 100 include a transceiver unit TC 112 which is a hand-held key ring having an appropriate array of finger tip switches 114, 116, 118, 122, 123, 128, as well as a liquid crystal display (LCD) 120 in the case or housing 124 which can include a key ring 126 on a swivel connection. The LCD 120 is a conventional LCD that is well known in the art. The LCD as well as switches 114, 116, 118, 122, 123, and 128 are means for communicating input from an operator of the device 100. The switches 114, 116, 118 each correspond to a different vehicle control function. The switches 122, 123, 128 correspond to a different communication function described below.

The hand-held case can be retained by the operator so that as the operator approaches the vehicle 32, signal S4 can be transmitted to a vehicle receiver R by merely depressing one of the finger operated switches 114, 116, 118. Alternatively, the operator can retain the hand-held case 124 so that as the operator approaches another operator having another transceiver unit TD 130, signal S4 can be transmitted to the transceiver unit TD by depressing switch 128. The range of the signals transmitted is within 50–100 feet.

Transceiver unit TD 130 is similar to transceiver unit TC 112 except that transceiver unit TD has a unique security code different than transceiver unit TC. The security code permits communication of signals only between the desired transceivers and the desired receiver in the vehicle to prevent unauthorized access to the vehicle and/or the transceivers, as mentioned above.

The vehicle includes a controller and a receiver R for receiving and for processing the signal with stored vehicle subroutines that include the vehicle control functions, described hereafter.

Another component of the device 100 is transceive circuitry located in the transceiver units TC 112 and TD 130. If the operator wishes to carry out a vehicle control function, the operator simply depresses one of the switches 114, 116, 118 to generate a radio frequency signal S4 corresponding to the switch depressed which is received by the vehicle receiver R mounted on the vehicle 32.

Referring now to FIG. 4, if the operator depresses switch 116, a signal S4 is generated and is transmitted for receipt by the vehicle receiver R indicating that the vehicle doors should be unlocked. The vehicle receiver includes receive circuitry which processes the signal. The vehicle controller executes the control function by unlocking the doors of the vehicle.

If the operator depresses switch 114, a signal S4 is generated and is transmitted for receipt by the vehicle receiver R indicating that the vehicle doors should be locked. The vehicle controller executes the control function by locking the doors of the vehicle.

If the operator depresses switch 118, a signal S4 is generated and is transmitted for receipt by the vehicle receiver R indicating that the trunk should be released. The vehicle controller executes the control function by releasing the trunk of the vehicle.

Figure 5:
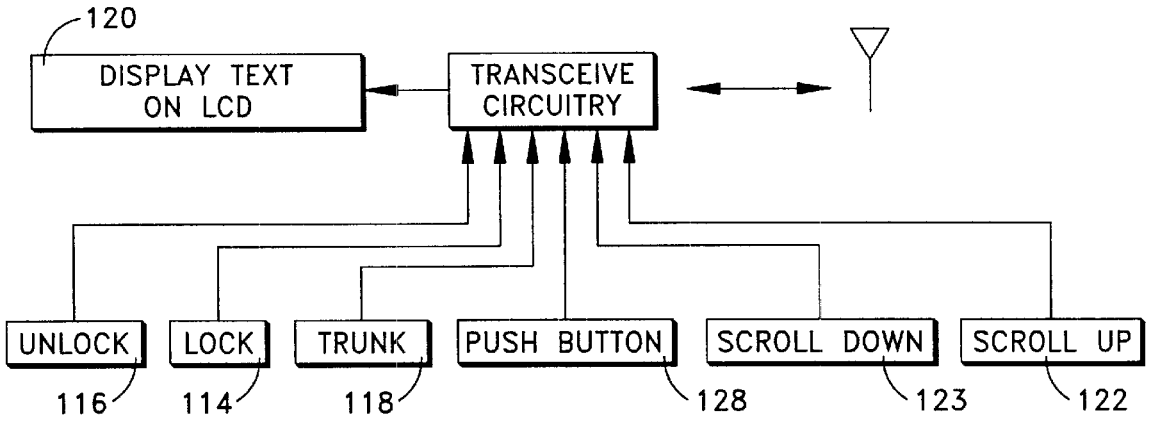
FIG. 5 is a block diagram illustrating, schematically, the device of FIG. 1.

Using the same transceiver unit TC 112 (FIG. 2), the operator can communicate a text message to the operator of transceiver unit TD 130 and vice versa (FIG. 5). If the operator of transceiver unit TC 112 wishes to send a text message to the operator holding transceiver TD 130, the operator simply depresses the scroll up switch 122 to access stored memory of the transceive circuitry which contains a plurality of pre-programmed text messages. The messages are displayed on the LCD 120 and the operator makes a desired selection using the scroll up 122 and scroll down 123 switches and by depressing the pushbutton 128 which transmits the message for receipt by transceiver unit TD 130.

Examples of text messages include "CALL HOME"; "CALL DAD"; "CALL MOM"; "PICK UP KIDS"; "PICK UP MILK"; "CALL WIFE"; "CALL HUSBAND"; "CALL WORK"; "TURN LEFT"; "TURN RIGHT"; "TAKE NEXT EXIT"; "PULL OVER"; "I AM LOST"; "TOO FAST"; "HELLO"; "GOOD-BYE". This is not an exhaustive list.

The transceive circuitry converts the text message into digital signals, specifically, radio frequency signals S5 and feeds them to a broadcasting transmitter. The broadcasting transmitter is part of the transceive circuitry of the transceiver unit TC 112.

The broadcasting transmitter transmits the signals S5 for receipt by transceiver unit TD 130. The transceiver unit TD 130 includes transceive circuitry for converting the signals S5 into text messages that are displayed on the LCD 120 to the operator of transceiver unit TD 130. The displayed message outputted is the same text message communicated by the operator of transceiver unit TC 112.

If the operator of transceiver unit TD 130 wishes to send a reply message to, or to initiate communication with, the operator holding transceiver TC 112, the operator of transceiver unit TD simply follows the same process as the operator of transceiver unit TC.

As mentioned above, the transceiver unit TC 112 is the same as transceiver unit TD 130 except for the unique security code. Thus, the operator of transceiver unit TD 130 depresses the scroll up switch 122 to access stored memory of the transceive circuitry which contains a plurality of pre-programmed text messages. The messages are displayed on the LCD 120 and the operator makes a desired selection using the scroll up 122 and scroll down 123 switches and by depressing the pushbutton 128 which transmits the message for receipt by transceiver unit TC 112.

The transceiver unit TD 130 also includes transceive circuitry for converting the text messages into digital signals, specifically, radio frequency signals S6 and also feeds them to a broadcasting transmitter. The broadcasting transmitter is part of the transceive circuitry of the transceiver unit TD 130.

The pushbutton 128 located on one of the lateral sides of the case 124 of transceiver unit TD 130 transmits the signals S6 for receipt by transceiver unit TC 112. The transceiver unit TC 112 includes transceive circuitry for converting the signals S6 into a text message displayed on the LCD 120. The text message displayed is the same text message selected and transmitted by the operator of transceiver unit TD 130. As with the transceiver unit TC 112, the transceiver unit TD 130 can also send signals to the vehicle for controlling vehicle access.

Figure 7:
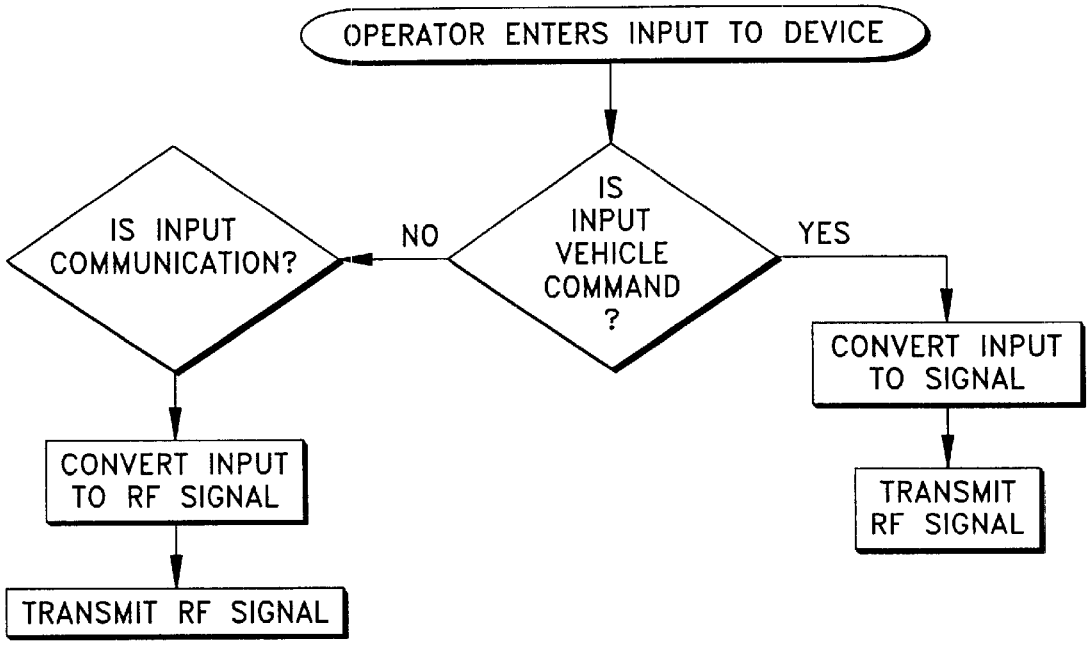
FIG. 7 is a block flow chart illustrating the system concepts.
Figure 8A:
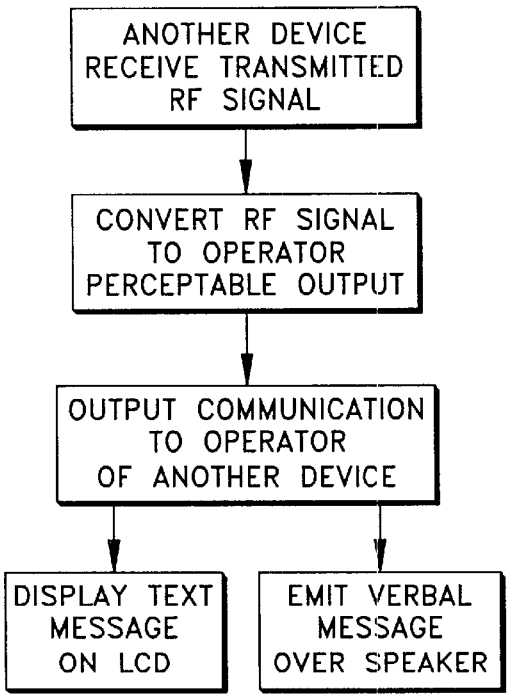
FIG. 8*a* is a block flow chart illustrating the system concepts.
Figure 8B:
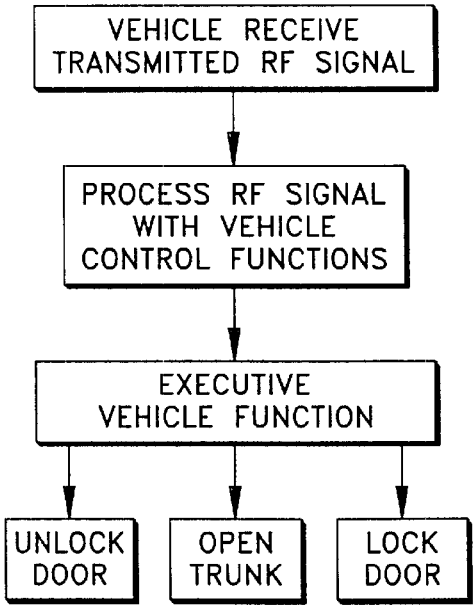
FIG. 8*b* is a block flow chart illustrating the system concepts.

The flow diagrams of FIGS. 7, 8*a* and 8*b*, illustrate the concepts of the invention from an operator entering input into a device to the result of the vehicle unlocking or locking the vehicle doors or releasing the trunk, or the result of outputting a message sent to another device.

Figure 9:
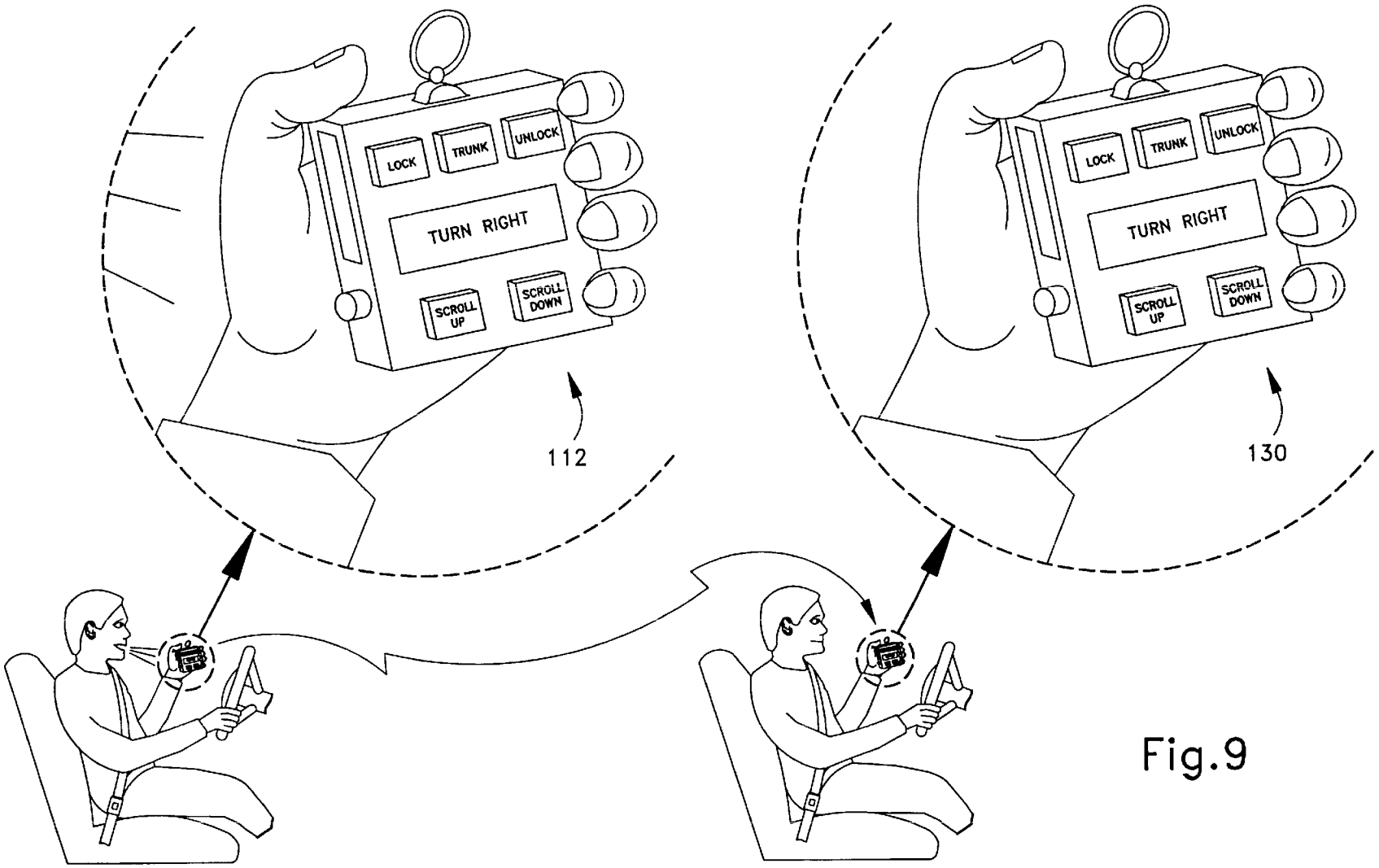
FIG. 9 is a pictorial view of the operation of two of the devices of FIG. 2.

Thus, the transceiver units can be used to both to control access to a vehicle and for verbal as well as textual interpersonal communication. The device provides a solution for the need for communication between drivers of vehicles or passengers of vehicles who resort to traditional hand gestures, CB radios, cellular telephones and the like without distraction from the task of operating the vehicle (FIG. 9). The device eliminates the need for a separate RKE and a separate digital or other communications device such as a cellular telephone.

Although the device 10 and the device 100 are described and illustrated as separate devices, they can be combined into a single device having both verbal and textual communication functions as well as a remote vehicle access function.

Figure 10:
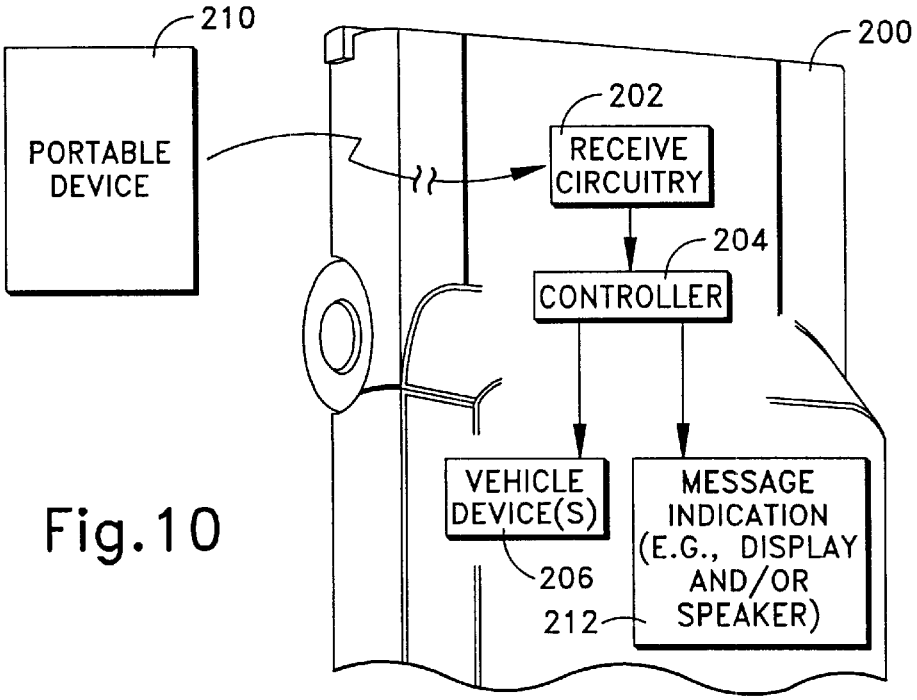
FIG. 10 is a schematic illustration of another embodiment of the present invention.

FIG. 10 illustrates an embodiment of the present invention that utilizes the signal receiving capability at a vehicle 200. Specifically, the vehicle 200 has receive circuitry 202 for receiving a vehicle convenience control signal from an associated portable device (not shown). The authorized vehicle user (not shown, e.g., the vehicle owner) holds the associated portable device. Upon receipt of the convenience control signal, a controller 204 at the vehicle 200 causes performance of a remotely-controlled function at an associated device 206 (e.g., a door lock actuator) at the vehicle.

The embodiment of FIG. 10 utilizes the receive circuitry 202 to receive a communication message signal from another portable device 210. The other portable device is not necessarily able to control remote functions at the vehicle 200. As such the other portable device 210 is not associated with the vehicle in the same sense as the portable device that does remotely control vehicle functions. Still, the other portable device 210 outputs a signal that is receivable by the receive circuitry 202.

The ability to receive both an authorized signal for causing remote control of a vehicle function and a communication signal may be via any suitable configuration. For example, both types of signals may be at the same frequency and same data format, but the remote control signal may contain an authorization code. As such, the contents of both signals (remote control and communication) are conveyed by the receive circuitry 202 to the controller 204 and the controller distinguishes the signal type and responds accordingly.

Turning to the issue of receipt of a communication signal from the non-associated portable device 210, the controller 204 is operatively connected to a message indication device 212 at the vehicle 200. The message indication device may include a display unit for displaying alphanumeric characters, a speaker for emitting voice or other sound notifications (e.g., a notification tone), or other components. As such, a person within the vehicle 200 is capable of receiving communication from the holder of the portable device 210. The holder of the portable device 210 may even be located in another vehicle (not shown).

The portable device 210 may be of the same type of device as the devices shown in either FIG. 1 of FIG. 2. However, the communication is not from one portable device to another portable device, as was shown in FIG. 3, but rather from the portable device to the vehicle for provision to a vehicle occupant thereat.

Figure 11:
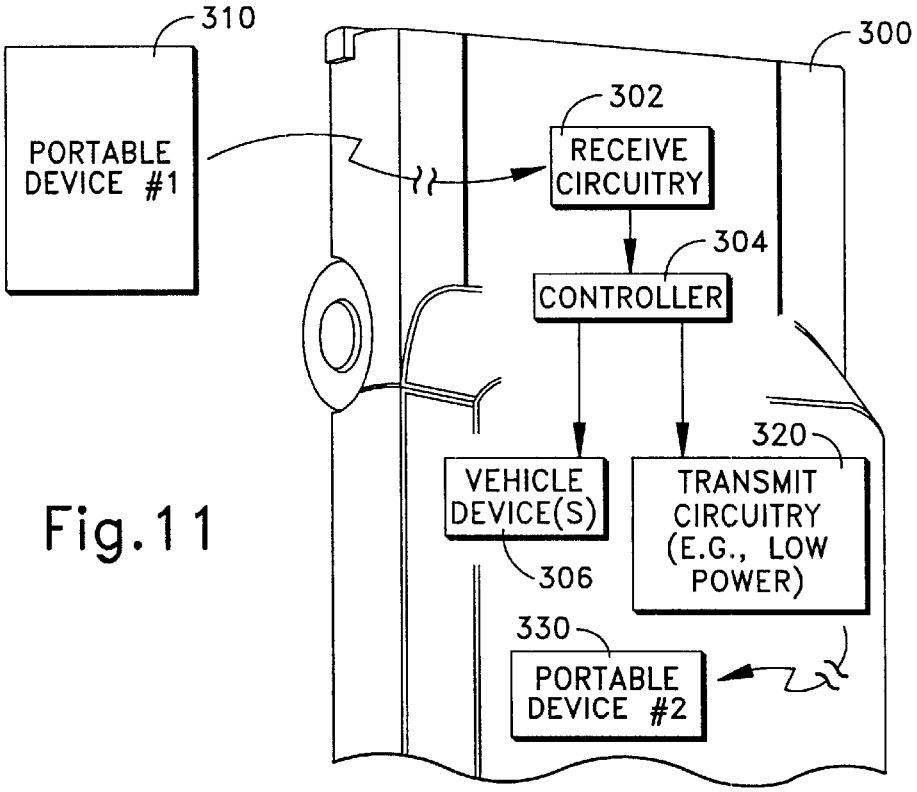
FIG. 11 is a schematic illustration of yet another embodiment of the present invention.

FIG. 11 illustrates an embodiment of the present invention that utilizes the signal receiving capability at a vehicle 300, similar to the embodiment of FIG. 10. Specifically, for the embodiment of FIG. 11, the vehicle 300 has receive circuitry 302 for receiving a vehicle convenience control signal from an associated portable device (not shown). The authorized vehicle user (e.g., the vehicle owner) holds the associated portable device. Upon receipt of the convenience control signal, a controller 304 at the vehicle causes performance of a remotely-controlled function at an associated device 306 (e.g., a door lock actuator) at the vehicle 300.

The embodiment of FIG. 11 utilizes the receive circuitry 302 to receive a communication message signal from another portable device 310. The other portable device 310 is not necessarily able to control remote functions at the vehicle 300. As such, the other portable device 310 is not associated with the vehicle 300 in the same sense as the portable device that does remotely control vehicle functions. However, the other portable device 310 outputs a signal that is received by the receive circuitry 302. The ability to receive both an authorized signal for causing remote control of a vehicle function and a communication signal may be via any suitable configuration, similar to the embodiment of FIG. 10.

Turning to the issue of receipt of a communication signal from a non-associated portable device 310 (FIG. 11), the controller 304 is operatively connected to transmit circuitry 320 at the vehicle 300. The transmit circuitry 320 transmits a signal that conveys the communication message and which is intended for reception by a portable receiver 330 located near (e.g., within the passenger compartment) the vehicle 300. Specifically, the portable receiver 330 may be similar to either the device 30 (FIG. 3) or the device 130 (FIG. 9). As such the structure 302, 304, and 320 at the vehicle 200 acts to relay the communication from the first portable device 310 to the second portable device 320.

From the above description of the invention, those skilled in the art will perceive improvements, changes and modifications. Such improvements, changes and modifications within the skill of the art are intended to be covered by the appended claims.

Having described the invention, the following is claimed:

1. A system for controlling a remote convenience function at a vehicle and for interpersonal communication, said system comprising:

a device having components located in a common housing, said components comprising:

means for communicating inputs from an operator of said device, the inputs including a request to remotely control performance of a convenience function at the vehicle and an interpersonal communication;

means for converting the inputs from the operator of said device into radio frequency signals; and means for transmitting the signals for receipt at the vehicle and at a component;

first means, at the vehicle, for receiving one of the transmitted signals to cause performance of the remotely requested vehicle function at the vehicle;

second means, at the component, for receiving another of the transmitted signals to convey the interpersonal communication; and means, associated with the component, for converting the other signal into output perceptible by a person as the communication.

2. The system according to claim 1 wherein the component is a second vehicle, said second means for receiving is also means for receiving a transmitted signal from another device to cause performance of a remotely requested vehicle function at the second vehicle.

3. The system according to claim 2 wherein said means for converting the other signal into output perceptible by a person as the communication is mounted in the second vehicle.

4. The system according to claim 3 wherein said means for converting the other signal into output perceptible by a person as the communication is an alphanumeric display.

5. The system according to claim 3 wherein said means for converting the other signal into output perceptible by a person as the communication is a speaker.

6. The system according to claim 2 further including means, located at the second vehicle, for retransmitting the other signal, and means for receiving the retransmitted other signal, said means for receiving the retransmitted other signal being at another device operable to cause performance of a remotely requested vehicle function at the second vehicle, said means for converting the retransmitted other signal into output perceptible by a person as the communication being at the other device.

7. The system according to claim 1 wherein the component is another device to cause performance of a remotely requested vehicle function at a second vehicle.

8. A device for controlling a remote convenience function at a vehicle and for interpersonal communication, said device having components located in a common housing, said components comprising:

means for communicating input from an operator of said device;

means for converting the input from the operator of said device into radio frequency signals;

means for transmitting the signals for receipt by one of the vehicle and another device;

means for receiving another radio frequency signal transmitted from the other device, the other signal being generated from communication input from an operator of the other device; and means for converting the other signal into output perceptible by the operator of said device, the output corresponding to the input communication from the operator of the other device.

9. The device according to claim 8 wherein said means for communicating input from the operator of said device includes a microphone for receiving verbal communication from the operator of said device and a switch for causing transmission of the signal conveying the verbal communication for reception by the other device.

10. The device according to claim 8 wherein said means for communicating input from the operator of said device includes a plurality of fingertip switches, and said switches including switches for selecting a pre-programmed text message from a plurality of pre-programmed text messages and a switch for controlling-transmission of the signal conveying the text message to the other device for reception by the operator of the other device.

11. The device according to claim 8 wherein said means for communicating input from an operator of said device includes a plurality of finger tip switches, said switches including a switch for transmitting a signal to the vehicle for unlocking the vehicle door lock mechanism, a switch for transmitting a signal to the vehicle for locking the vehicle door lock mechanism and a switch for transmitting a signal to the vehicle for releasing the truck of the vehicle.

12. The device according to claim 8 wherein said means for converting the input into radio frequency signal includes a transceiver having transceive circuitry.

13. The device according to claim 12 wherein said transceive circuitry includes memory means for storing the plurality of pre-programmed text messages.

14. The device according to claim 12 wherein said transceive circuitry includes said means for converting the other signal into output perceptible by the operator of said device.

15. The device according to claim 12 wherein, said device includes a liquid crystal display located on said housing of said device for displaying one of the plurality of pre-programmed text messages.

16. The device according to claim 8 wherein, the output perceptible by the operator of said device is audible sound and said means for converting the signal from the other device into the audible sound includes a speaker.

17. A system comprising:

first and second devices, each of said first and second devices for performing the combination of controlling a vehicle remote convenience function and an interpersonal communication function, said first device being operated by a first operator, said second device being operated by a second operator, each of said first and second devices having components located in a common housing, said components of said first device comprising:

means for receiving a communication signal from said second device;

means for processing the communication signal received from said second device to provide communication to the first operator;

means for processing input from the first operator indicating which of the functions to perform;

means for generating a communication signal and a vehicle remote convenience function signal from the first operator input; and means for transmitting the communication signal from said first device for receipt by said second device, and for transmitting the vehicle remote convenience function signal from said first device for receipt by a vehicle.

18. The system of claim 17 wherein the communication signal correspond to a verbal message.

19. The system of claim 17 wherein the communication signal correspond to a text message.

20. The system of claim 17 wherein the vehicle remote access function corresponds to a function of locking the vehicle doors, a function of unlocking the vehicle doors, or a function of releasing the truck of the vehicle.

* * * * *